United States Patent [19]

Krive

[11] Patent Number: 4,629,181

[45] Date of Patent: Dec. 16, 1986

[54] MULTI-DIRECTIONAL MOVEMENT LEG EXERCISER

[76] Inventor: Irwin M. Krive, 31 Slocum Ave., Port Washington, N.Y. 11050

[21] Appl. No.: 516,149

[22] Filed: Jul. 21, 1983

[51] Int. Cl.[4] ..... A63B 69/18

[52] U.S. Cl. ..... 272/97; 272/146

[58] Field of Search ..... 272/96, 97, 146, DIG. 5, 272/DIG. 6; D21/193

[56] References Cited

U.S. PATENT DOCUMENTS

| | | | |
|---|---|---|---|
| 2,779,642 | 1/1957 | Matthews | 272/146 |
| 3,159,400 | 12/1964 | Brass et al. | 272/97 |
| 3,461,857 | 8/1969 | Poulin | 272/97 |
| 3,466,040 | 9/1969 | Sertich | 272/96 |
| 3,582,066 | 6/1971 | Keryluk | 272/97 |
| 3,593,994 | 7/1971 | Anbar | 272/146 |
| 3,644,919 | 2/1972 | Mathauser | 272/97 |
| 3,834,693 | 9/1974 | Poppenberger | 272/97 |
| 3,935,669 | 2/1976 | Potrzuski et al. | 272/97 X |
| 4,074,446 | 2/1978 | Eisenberg | 272/96 |
| 4,223,887 | 9/1980 | Holtz | 272/DIG. 5 |
| 4,342,453 | 8/1982 | Wagner | 272/97 |
| 4,429,869 | 2/1984 | Eckstein | 272/97 |

FOREIGN PATENT DOCUMENTS

| | | | |
|---|---|---|---|
| 860785 | 9/1981 | U.S.S.R. | 272/96 |
| 931200 | 6/1982 | U.S.S.R. | 272/97 |

*Primary Examiner*—Richard J. Apley
*Assistant Examiner*—S. R. Crow
*Attorney, Agent, or Firm*—Hoffmann, Dilworth, Barrese & Baron

[57] ABSTRACT

An exerciser adapted for use in simulating skiing and the like including a base and a turntable rotatably mounted on the base. Thus, foot supports are mounted on the turntable so as to be rotatable therewith. The foot supports are movable with respect to the turntable and with respect to one another upon application of a predetermined amount of foot pressure so as to permit canting thereof in two opposing directions and pivoting in a third direction thereby permitting the user to selectively shift feet, legs, and body when engaged with the foot supports in any one of four directions of movement depending on the application of pressure thereto and accordingly exercising the users legs and body in a desired manner.

16 Claims, 10 Drawing Figures

MULTI-DIRECTIONAL MOVEMENT LEG EXERCISER

BACKGROUND OF THE INVENTION

In today's world, frequent exercise is recommended for most people whether their daily activities are generally sedentary or considerably more athletic. It is considered a healthy practice in regard to both mind and body.

Often, adequate exercise facilities and equipment are not easily accessible and the person is discouraged from going through desirable exercise procedures, for example, a body, control weight, and as a preventive measure against injury when the person is to be subjected to more violent exercise in the near or distant future.

With this in mind, many types of exercise machines have been developed for the home and office which can be easily maintained and stored in confined locations where they are available for use at any time of day or night for brief or prolonged periods of exercise.

One particular class of individuals who find exercise devices attractive and beneficial are casual and serious skiers. In many cases, the skier does not have daily access to ski slopes for frequent practice and exercise. Additionally, skiing is a seasonal activity. Therefore, particularly casual skiers usually have long periods of inactivity between skiing excursions. During this time, the muscles frequently used in skiing are normally not subjected to exercise. Thus, these muscles are not toned and strengthened to accept the physical shock of skiing and the risk of injury is greatly increased.

It is well known that skiing is a strenuous sport and requires considerable training in order to develop skills and protect and tone the body against injury. Accordingly, many types of ski trainers and exercising devices have been developed over the years. These devices have taken a variety of different shapes and forms and are generally complex, large, and expensive. Additionally, while they provide for foot, leg, and body motions utilized in a skiing environment, they are all lacking in one or more phases of movement so that they do not very accurately reproduce a skiing environment. There is clearly room for an improved, inexpensive, compact device which is easy to operate and provides the user with all of the significant foot, leg, and body movements of a skier to more closely simulate the actual environment on the ski slope.

The following patents show examples of the prior developed devices. U.S. Pat. No. 3,021,137 shows a ski trainer with a turning board containing foot holders which is shiftable by the skier between positions on a pair of turning boards in order to simulate a type of lift and rotational action such as might be encountered on a ski slope.

U.S. Pat. No. 23,159,400 is basically involved with a game apparatus for simulating skiing in which the user places his feet on a type of foot platform which has a partial foam base so that the feet can be tipped and some rotational action is achieved as well in the simulation procedure.

U.S. Pat. No. 3,207,510 involves a ski training device in which the user affixes his feet to a rectangular spring loaded platform and by adjusting weight distribution can effect a rotational action.

U.S. Pat. No. 3,531,110 shows another type of ski simulator where ski-like structures are engaged by the user and are spring loaded and capable of being individually rotated a certain distance.

U.S. Pat. No. 3,582,066 shows another type of ski trainer and exerciser in which foot pedals can be engaged and rotated and tilted within prescribed limits to simulate in some respects certain motions in skiing.

U.S. Pat. No. 3,659,842 deals with a dry land ski training device in which support brackets are attached to cantilever arms having a predetermined resiliency to simulate movements.

U.S. Pat. No. 4,074,903 extends the ski simulator a further degree by making it adaptable for use with a motion picture presentation. Electrical solenoid plungers rock and vibrate a skier's platform and the boot platforms are mounted on ball bearings to permit a simulated turning motion.

Finally, U.S. Pat. No. 4,252,312 is concerned with gymnastic apparatus for executing simulated skiing movements and the majority of the movement is achieved through rocking or sliding parts across spherical or ball surfaces.

While all of the above devices have some advantages and simulate some types of ski action, there are obvious shortcomings in their construction and use.

Consideration should also be given to the use of the exerciser with electrical sensing means to monitor, indicate and control the exerciser action in order to follow a predetermined program or to study the results of the exercising activity. Additionally, by use of suitable electrical controls, there are many environments in which an exerciser can be used to coordinate hand or eye activities or other portions of the body with the leg and foot motion of the user as he operates the exerciser.

It is also conceivable that exercisers of the type under consideration could be adaptable for use in the electronic video game environment and with computers in general to monitor, calculate, and analyze the exercising action. The above discussed references are noticably deficient in this respect and only several of the above discussed patents even touch upon this aspect of coordination between mechanical and electrical or electronic systems.

SUMMARY OF THE INVENTION

With the above background in mind, it is among the primary objectives of the present invention to provide an exerciser designed to be operated quickly and effectively by the user to provide predetermined exercise movements, for example, simulated skiing movements where the user is able to move feet, legs, and body in four different directions. The skier is able to move either of his two feet, independently mounted on separate foot supports, either in a canted left or right direction, a front to back pivot, or rotationally.

It is a further object of the present invention to provide an exerciser which is inexpensive to manufacture, compact, and easy and efficient to use and store in many environments including home and office. The device is portable and can be transported by the user during his travels from location to location.

Still a further objective is to provide an exerciser which is useful for many types of exercise sequences including but not exclusively skiing. The exerciser can be quickly engaged for use and disengaged after use thereby enhancing the attractiveness to the user for repeated and frequent exercising procedures at any time of day or night.

It is another objective of the invention to include an embodiment of the exerciser formed with electrical sensor switches and controls and connectable by a suitable electrical interface to a monitor to display output of the sensors in response to movement of the foot supports as the user executes the variety of different movements within the capability of the exerciser. This includes movements in the left and right canted directions, pivoting from front to back and back to front, and rotational movement. Switches are provided to monitor each of the two foot supports as the operator indepently moves one or both feet in the simulated skiing or exercising action.

It is contemplated that the controls can be coordinated with many types of known electrical, electronic, or electro-mechanical display or monitoring means. The system can be expanded to incorporate hand and eye coordination independently and in cooperation with foot movement for monitoring purposes, as part of a game environment, or for training, study, and analysis.

In general, the exerciser or body controller has a base upon which a turntable is mounted by means of a mechanism which includes a load bearing surface. Affixed to the top of the turntable are two parallel, independently mounted, rectangular, inclined foot rests or supports having toe stops or walls attached to the upper surface of the downward edge. These foot rests are attached to the turntable by a wedge shaped rubber block or support affixed under the heel end, and a pivot mechanism or cylindrical member at the toe end.

In an alternative form, under the left, right, and rear surface of each foot rest there is mounted an electrical sensor measuring angular and/or pressure differentials. Each sensor is connected to an electrical interface such as, but not limited to, a terminal block. On the underside of the turntable there is a sensor device capable of measuring horizontal rotational displacement of up to 360° or any part thereof. The means at any point or range. This sensor also connects to an electrical interface such as, but not limited to, a terminal block.

In use, each foot rest may move or pivot vertically, or tilt or cant left, or right, from a horizontal plane, in tandem or independently, while a turntable they are mounted on is rotating in a horizontal plane or remains static. The sensors described earlier will output a combined set of discrete electrical signals that define a uniform description of body position at any given instant in time relative to the local vertical.

The body controller or exerciser functioning as an electrical, mechanical sensor control unit is activated by transmitting body motions primarily through either, or both legs, and can be coupled to additional motion and/or position sensing devices, hand or otherwise activated. It may also be coupled to a hand, or otherwise activated trigger. When used in conjunction with a computer device, the body controller allows a wide range of leg, body and hand movement to immediately interact with a game plan. This permits dimensional maneuvering by transmitting decisions through body movement to a display. Body english, in a horizontal rotary plane and/or vertical weighting—unweighting and/or an angulation of each or both legs are possible but not all inclusive responses available to a user.

Some suggested, but not inclusive uses are as a space platform to provide maneuvering to escape enemy missiles, as a skiing platform for a novice, intermediate, expert, olympic courses, as a personal jet pack for navagating celestial obstacle courses, as a surfing board for big wave configurations around the world, in broken field running such as in dodge ball, football, animal attack changing labyrinth, and as a body toner to provide for simple to complex physical sequences, simon says games, rhythm reducing, and gymnastics.

Thus, it is an objective to provide a versatile and useful structure either as a simple mechanical exerciser or as a more complex electrical or electronic device to be used with suitable monitoring, video, and computer systems.

In summary, the exerciser includes a base and a turntable rotatably mounted on the base. Foot support means is mounted on the turntable so as to be rotatable therewith. The foot support means is movable with respect to the turntable upon application of a predetermined amount of foot pressure so as to permit canting thereof in two opposing directions and pivoting in a third direction thereby permitting the user to selectively move his feet when engaged with the foot support means in any one or in a combination of four directions of movement depending on the application of leg and foot pressure thereto and accordingly allowing the user to exercise in a desired manner.

The exerciser is adapted for use with sensing means positioned so as to monitor the degree and type of the foot support means as the user moves the foot support relative to the base in the permitted manner. Display means is then responsive to the sensing means to indicate the type and degree of sensed movement of the foot support as the user operates the exerciser.

In one form, the sensing means includes at least one electrical sensor switch and the display means includes an electrical display board interconnected by a releasable electrical interface.

With the above objectives among others in mind, references made to the attached drawings.

DETAILED DESCRIPTION

Figure 1:
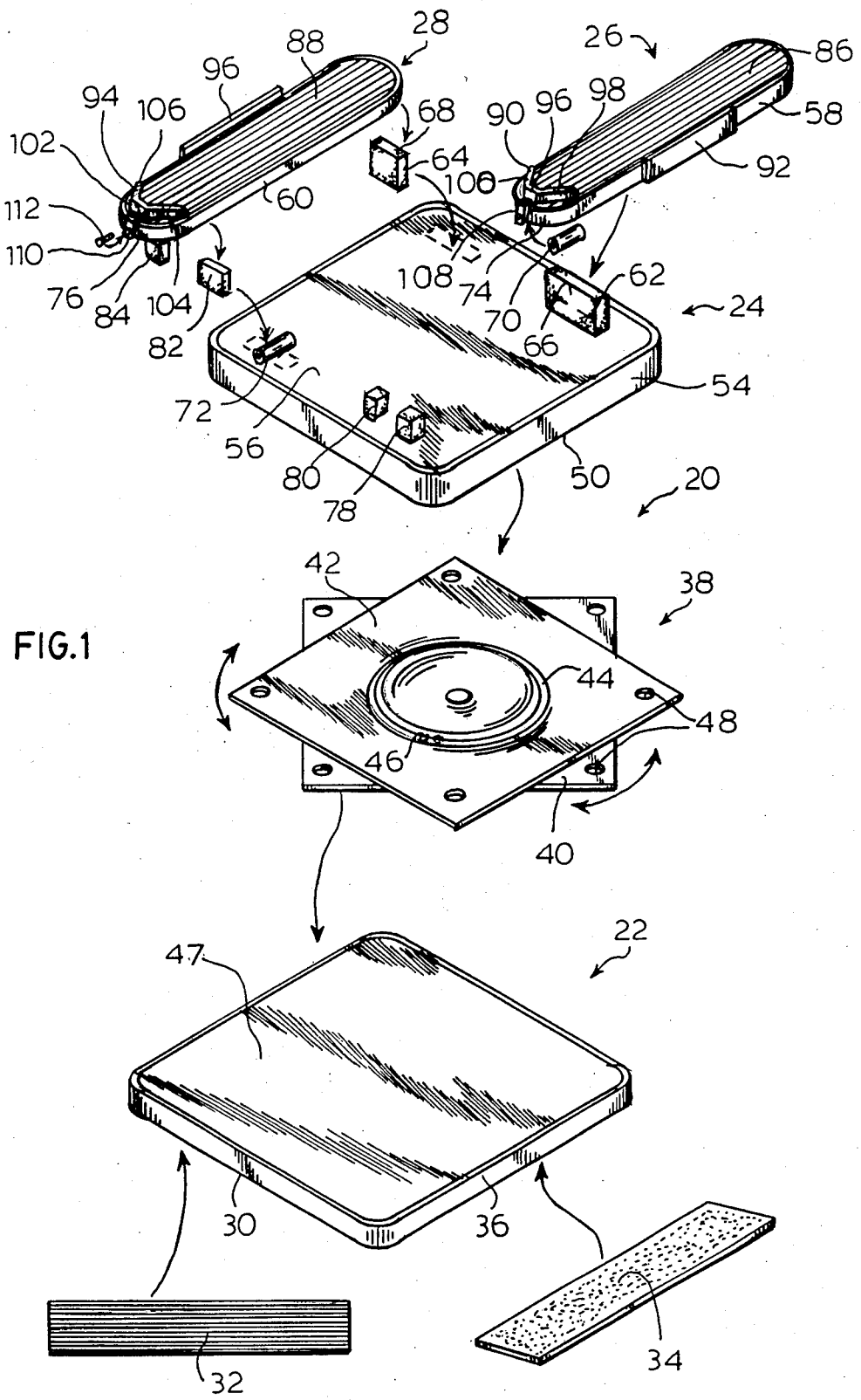
FIG. 1 is an exploded perspective view of the exerciser.

Exerciser 20, in a first embodiment is depicted in FIGS. 1–6. Among the components of the assembly, are a base 22, a turntable 24, and foot support means in the form of a pair of foot supports 26 and 28. Turntable 24 and base 22 are substantially square and turntable 24 is smaller than base 22. The foot supports 26 and 28 are elongated members designed to support the shoe or foot of the user. The configuration of the base and turntable is a matter of choice with a square shape being a convenient selection although these members could be rectangular, oval, circular, or have any other convenient polyagonal configuration.

Underside 30 of base 22 is provided with a suitable frictional surface to alleviate the danger of the user slipping when operating the exerciser 20. For this purpose, a pair of spaced ribbed rubber rectangular pads 32 and 34 are affixed to underside 30 of base 22.

A plastic band 36 is bonded to the peripheral edge of the base 22 to guard against damage to the wooden base 22. Naturally, alternative materials can be employed for the base including plastic and metal as long as the base has sufficient strength to support the remainder of exerciser 20 and bear the weight of the user and stress applied during use.

Turntable 24 is rotatably mounted on base 22 by means of a bearing assembly 38. The bearing assembly includes a bottom plate 40 and a top plate 42 each with a grove therein to mate with one another and form a circular central race 44. Positioned in race 44 is a plurality of ball bearings 46 which forms the bearing surface and provides for the 360° relative rotation between base 22 and turntable 24. This is accomplished by mounting bottom plate 40 to the upper surface 48 of base 22 by conventional means such as screws passed through a plurality of apertures 48 in the plate and into the wooden base 22.

Similarly, top plate 42 is affixed to the underside 50 of turntable 24 by passing suitable screws through apertures 52 in top plate 42 and into the wooden turntable 24.

Turntable 24 is also formed of wood but could be formed of any other conventional substantially rigid material including a variety of common plastics and metals. Again, a protective plastic band 54 surrounds the peripheral edge of the turntable.

The foot supports 26 and 28 are mounted on the upper surface 56 of turntable 24. The foot supports 26 and 28 are aligned in spaced parallel relationship with one another and are inclined downwardly to a predetermined degree from heel to toe in the relaxed position to simulate positioning of the feet on a ski slope.

Each foot support is also formed of wood or any conventional substitute therefore. A protective plastic band 58 surrounds the peripheral edge of foot support 26 and a similar peripheral plastic band 60 surrounds the peripheral edge of the foot support 28. To support the heel portion of the foot supports, rectangularly shaped blocks of foam rubber 62 and 64 are affixed to the upper surface 56 of the turntable by a convenient means such as by an adhesive bonding agent. The upper end 66 of block 62 and upper end 68 of block 64 are beveled downwardly toward the toe to form a wedge shaped configuration and mate with the respective inclined foot supports. In this manner, upper end 64 can be adhesively bonded to the underside of the heel portion of foot support 26 and similarly, beveled upper end 68 of block 64 can be adhesively bonded to the underside of the heel portion of foot support 28. This forms the mounting means for the heel end of foot supports 26 and 28. While blocks 62 and 64 are formed of rubber, they can alternatively be formed of any conventional resilient substitute therefor. Adhesive bonding has been described in connection with the depicted embodiment, however, attachment can be achieved in any well known conventional manner.

To support the toe portion of each foot support, cylindrical members 70 and 72 are adhesively affixed in position beneath the toe end of the respective foot supports. The cylindrical members can again be formed of wood, plastic, metal, or any conventional material and can be affixed in any well known manner to the upper surface 56 of the turntable. The axis of each cylindrical member is aligned with the longitudinal axis of the foot support to which it is attached. The undersurface of each foot support is provided with a receiving recess to mate with a respective cylindrical member. Thus, cylindrical member 70 is seated within recess 74 on the underside of the toe portion of support 26 and cylindrical member 72 is seated in recess 76 on the underside of the toe portion of foot support 28.

With this type of mounting arrangement, the resilent nature of blocks 62 and 64 permit movement of the foot support in a canted direction both to the left and right and permits pivoting of the heel with respect to the toe to change the angle of incline of this foot support with respect to the turntable and base between the horizontal and the vertical. The cylindrical surface of members 72 and 70 permit canting of toe portions as well so that the entire length of each foot support can shift or rotate both to the right and left direction in a reciprocal manner.

As an additional element involved in the canting action and to cooperate with blocks 62 and 64 in resilently permitting a predetermined degree of cant before the resistance is sufficient to present further canting in either the right or left direction, a pair of smaller blocks of resilient rubber are positioned with each cylindrical member 72 therebetween. Thus, cylindrical member 70 is located between blocks 78 and 80 and cylindrical member 72 is located between blocks 82 and 84. The blocks 78, 80, 82, and 84 are smaller in size than blocks 62 and 64 to conform with the incline with which supports 26 and 28 are provided in the relaxed position. The blocks 78, 80, 82, and 84 also provide resilient resistance for the foot supports 26 and 28 as they are pivoted from toe to heel between the vertical and horizontal. The blocks 78, 80, 82, and 84 can be in engagement with the undersurface of foot supports 26 and 28 when they are in the relaxed position or slightly spaced therefrom as shown in the embodiment of FIGS. 1–6. They are not necessarily designed to provide a foundation for the foot supports 26 and 28 but to act as a resilent support during the pivoting and canting actions of the foot supports.

When foot supports 26 and 28 are mounted in this manner, they can be simultaneously moved in the same manner or independently moved in different manners either canting left or right or pivoting between toe and heel to simulate movements of a skier during a ski trip down a slope. Additionally, a fourth type of movement is provided by assembly 20 in that the foot supports being affixed to turntable 24 rotate with the turntable as well and thus permit a 360° rotation of the foot supports 26 and 28 with respect to the fixed base 22.

To facilitate positive engagement between the foot of the user and the foot supports, the upper surface of each foot support is provided with a frictional surface. As shown, a ribbed rubber pad 86 is adhesively bonded to the upper surface of foot support 26 and a similar ribbed rubber pad 88 is adhesively bonded to the upper surface of foot support 28. The pads can be separated or, as shown covering the majority of the upper surface of the foot support as long as a substantial portion of the surface is covered.

Also to assist in proper positioning and engagement and retention of engagement between the feet of the user and the upper surface of the foot supports 26 and 28, the foot supports are provided with a toe wall and an outer side wall. Thus, the toe end portion of foot support 26 includes toe wall 90 mounted thereon and side wall 92 adjacent the outer edge. Similarly, support 28 has a toe wall 94 mounted at the toe end and an outer side wall 96 mounted at its outer edge.

Each toe wall 90 and 94 is somewhat U-shaped in configuration to approximate the toe end of a boot or shoe of the user. Thus, toe wall 90 includes a central base portion 96 and a pair of diverging legs 98 and 100. Toe wall 94 includes a central base portion 102 and a pair of diverging legs 104 and 106 extending therefrom. Each of the toe walls 90 and 94 is a rigid L-shaped member with one leg of the L engaging the upper surface of the respective foot support and being mounted thereto by means of suitable screws or conventional substitute fasteners. The other leg extends upwardly therefrom to form the toe wall as shown.

The side walls 92 and 96 are substantially aligned and extend a partial distance along the length of the respective foot supports. The distance of extension of the side walls 92 and 96 is a matter of choice as long as there is an adequate engagement with the boot or shoe of the user as he shifts weight and cants and rotates the foot supports. Once again, the wall 92 and the wall 96 are formed of L-shaped members with the base leg being affixed by suitable conventional fasteners such as screws to the upper surface of the foot support and the remaining leg extending upward to form the wall for engagement by the users boot or shoe.

Finally, to retain positive engagement between the toe end of each foot support and the turntable, an L tie bracket is utilized. Thus, L tie bracket 108 has one leg screwed or bolted to the upper surface of the toe portion of foot support 26 and the other leg fastened to end of cylindrical member 70 mounted on turntable 24. Similarly, L tie bracket 110 has one leg fastened to the upper surface of the toe portion of support 28 and the other leg fastened to the end of cylindrical member 72. This fastening action can be formed in a conventional manner again such as by the use of appropriate screws 112. The attachment is also conventionally journalled so that the foot supports are permitted adequate freedom of movement with respect to the turntable in canting and pivoting actions.

The side walls and the toe walls and the L tie brackets are all formed of rigid metal material however, once again the conventional substitutes such as appropriate woods or plastics can be employed for the same purpose.

Figure 5:
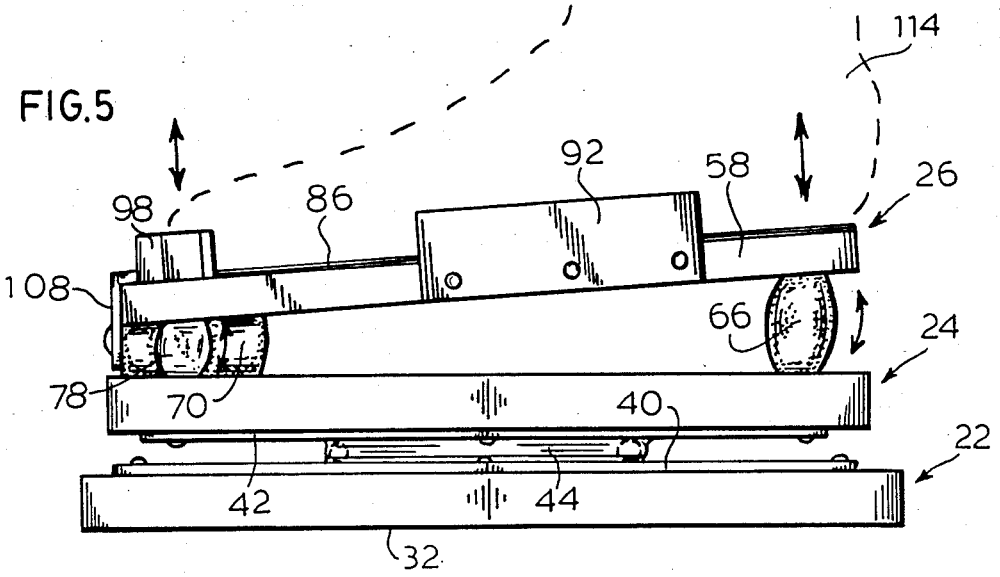
FIG. 5 is a side elevation view thereof with the users foot shown in phantom in engagement with the exerciser.
Figure 7:
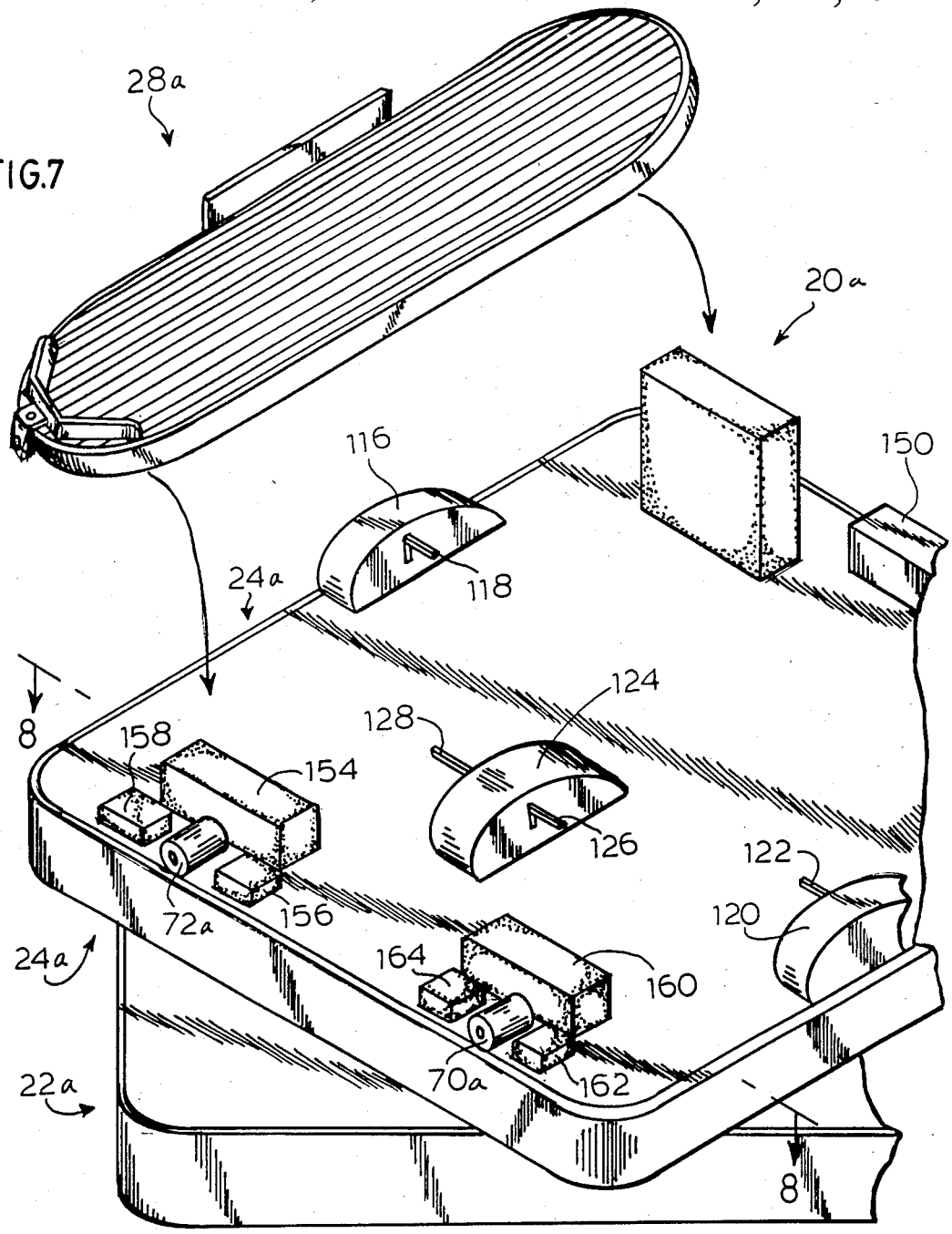
FIG. 7 is a fragmentary partially exploded perspective view of an alternative embodiment of the exerciser of the invention.
Figure 8:
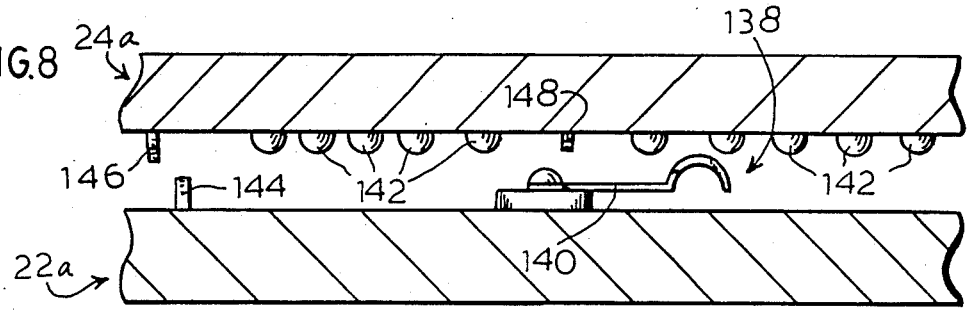
FIG. 8 is a fragmentary side elevation view thereof.

This completes the assembly of leg exerciser 20 and it is ready for use with the foot supports 26 and 28 adapted for movement in any one of the above described four directions. In use, the user positions each of his feet 114 on a respective foot support 26 and 28 as shown in FIG. 5. He is then ready to begin exercising. By moving either or both feet 114 in a left or right canting direction or by placing additional weight on the heel or by rotating the foot supports, appropriate movement is achieved to simulate the actual skiing movement of a skier as he moves on and down a ski slope. The four types of movement provide the type of movement suitable for exercise and training of the skier or in a beneficial exercise program for a non-skier. The damping effect of the resilent blocks is chosen at a predetermined level to provide the desirable and satisfactory resistance to movement so that true ski slope conditions are achieved.

Figure 6:
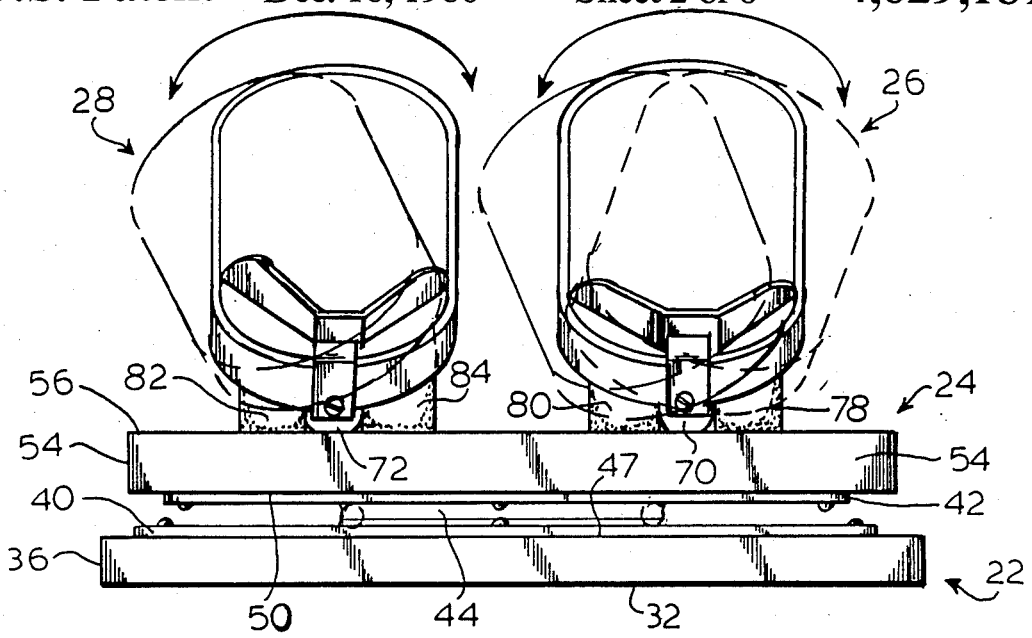
FIG. 6 is a schematic end elevation view thereof with the alternative canted positions of the foot supports shown in phantom and arrows depicting the direction of canting movement.
Figure 2:
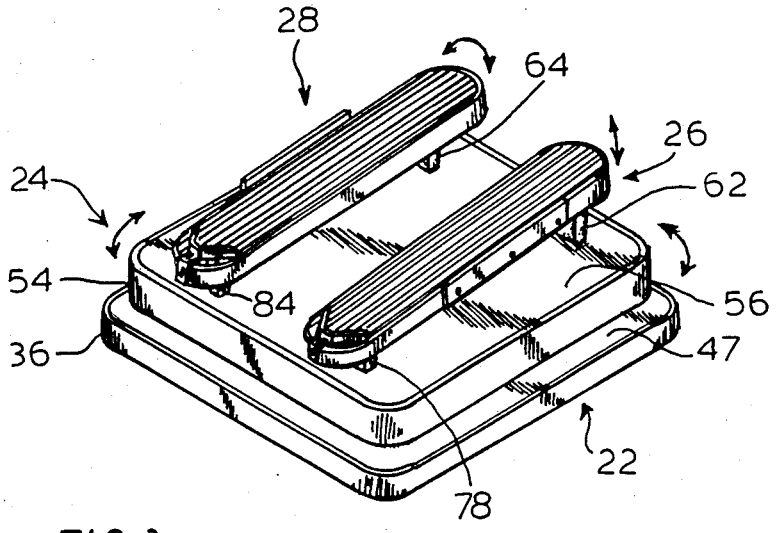
FIG. 2 is a perspective view thereof with arrows showing the movement directions.
Figure 3:
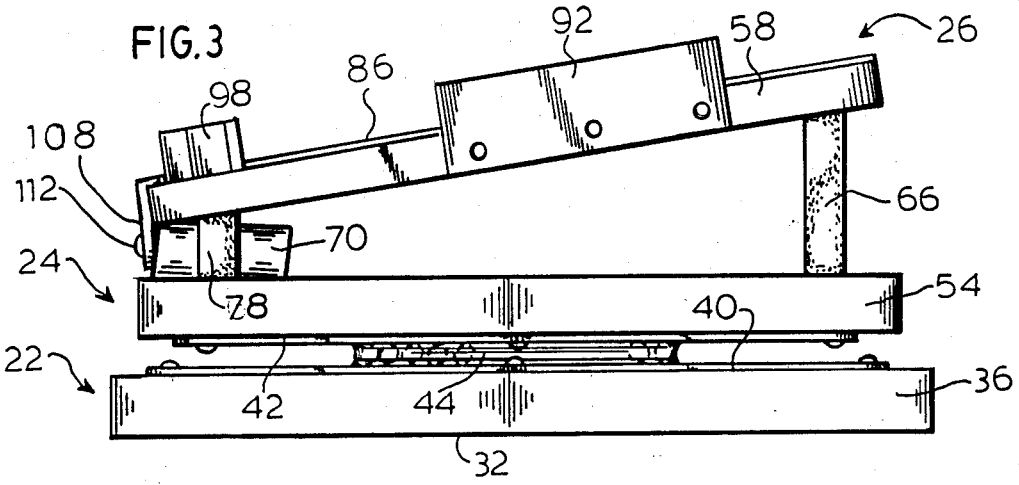
FIG. 3 is a side elevation view thereof.
Figure 4:
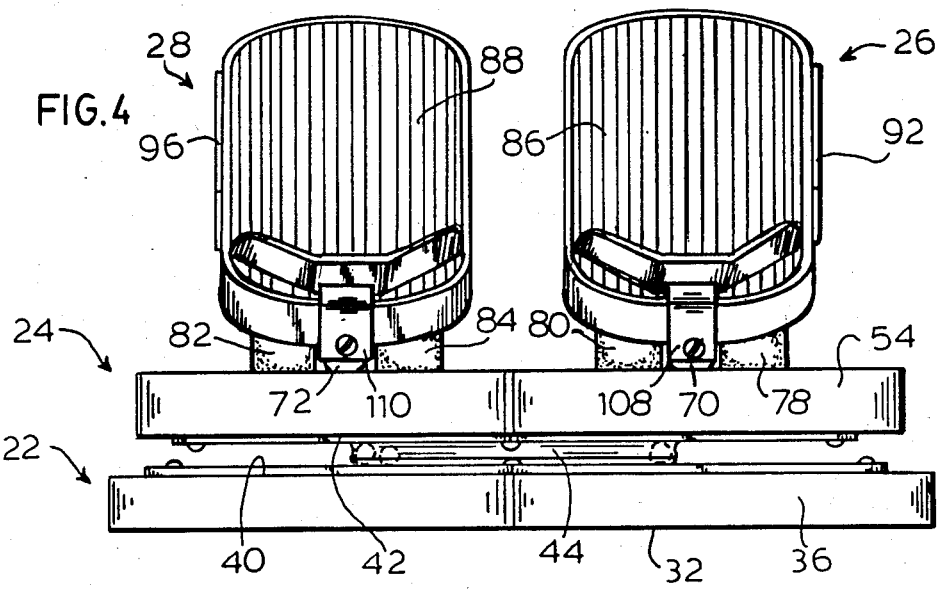
FIG. 4 is an end elevation view thereof.

The canting action of the foot supports 26 and 28 is depicted in FIG. 6 which shows the manner in which the skier achieves edging by canting the foot supports to the left and right against the resilient bias of the support blocks. Rotation is achieved by rotating the foot supports and attached turntable about base 22 over the bearing surface formed by the ball bearings 46. Priority is accomplished by a shift in weight distribution so the foot supports are moved to change the inclination with respect to the horizontal compression of the support blocks permits this type of movement as weight is applied to the heel.

The user disengages from exerciser 20 in the same type of quick and efficient manner that he engages the exerciser for use. He merely removes his feet from the foot supports as he is finished with the equipment. The foot supports will return to the relaxed inclined position that they were prior to use. No straps are necessary or required to hold the users feet in proper position with respect to the foot supports and the device 20 in general. All that is required is engagement between the users shoes and the toe and side walls on the foot supports and the ribbed rubber pads on the upper surface of the foot supports. With these supporting surfaces, the user can achieve the desired four types of movement without the use of further buckles, belts, or bindings. Thus, the exerciser 20 is formed of a minimum number of component parts and is easy, quick, and efficient to use.

An alternative embodiment of the exerciser is depicted in FIGS. 7–10. This embodiment is designed for use in an electrical or electronic environment. In mechanical structure, it is quite similar in design to the embodiment of figures 1–6 and, thus, similar parts are provided with similar reference numerals with the addition of the subscript "a" for the electrical embodiment of FIGS. 7–10.

Accordingly, exerciser **20*a* includes a base 22*a* with a turntable 24*a* mounted thereon and a pair of foot supports 26*a* and 28*a* affixed to the upper side of turntable 24*a*. However, in the embodiment of exerciser 20*a*, suitable electrical controls are added to the structure. An electrical sensor switch 116 is mounted on the upper surface of turntable 24*a* beneath the outer edge of foot support 28*a* so that its sensor 118** will be contacted by that edge of the foot support is canted to the right, for example, during a simulated edging movement.

Similar sensing means is provided for each of the other side edges of foot supports **26*a* and 28*a*. Accordingly, sensor switch 120 is in position to have its sensor 122 engage the outer edge of foot support 26*a*. A double sensor switch 124 is positioned between the foot supports so that one sensor 126 is located for engagement with the inner edge of foot support 28*a***. Once again, canting of the foot supports right or left will activate an appropriate electrical switch.

The pivoting action of the foot supports **26*a* and 28*a* is sensed by appropriate sensor switches located behind the resilent rubber blocks 62*a* and 64*a* thus, sensor switch 130 has its sensor 132** in position for engagement with the underside of the heel portion of foot support of 28*a* and sensor switch 134 has its sensor 136 in position for engagement with the underside of the heel portion of foot support 26*a*. In this manner, the pivoting between toe and heel of the foot supports during use of the exerciser is monitored.

The remaining type of motion, the fourth type of motion for the foot supports is accomplished through rotational motion between the turntable 24*a* and the base 22*a*. The amount and degree of rotation is monitored by electrical sensor switch assembly 138 with its sensor 140 in position for engagement with a series of contracts 142 arranged in an arcuate array. As shown, the sensor 140 is mounted on the upper surface of the base and the array of contacts 142 is mounted on the underside of the turntable. Therefore, as the turntable rotates, the contacts 142 will sequentially engage the sensor 140 indicating the degree and amount of rotation of the turntable, foot supports, and feet of the user.

In order to maintain relative positioning of the sensor 140 and the contacts 142, a stop 144 is mounted on the upper side of the base to project upwardly and engage with a pair of spaced stops 146 and 148 projecting downwardly from the underside of the turntable thereby limiting the degree of rotation.

All of the switches are connected by suitable wiring to a terminal block 150 on the upper side of the rear of the turntable 24*a*. Terminal block 150 has socket orifices to provide the electrical interface 152 to interconnect the exerciser 20*a* with a suitable display system.

Otherwise, exerciser 20*a* operates in the same manner as exerciser 20. Exerciser 20 does show another alternative structrual difference in regard to the arrangement of resilient rubber support blocks for the toe portions of the foot supports 28*a* and 26*a*. Instead of the pair of spaced small blocks used in connection with exerciser 20, an array of three rectangular blocks is provided for the same purpose as the two blocks in connection with exerciser 20. The three blocks include a larger rectangular block 154 and a pair of smaller spaced aligned blocks 156 and 158 surrounding the cylindrical member 72 in connection with foot support 28*a*. Similarly, cylindrical member 70*a* engaged with foot support 26*a* is surrounded by a larger rectangular rubber block 160 and two smaller spaced blocks 162 and 164. These resilent blocks have appropriate beveled upper surfaces to accomodate the inclined slope of the under surface of the foot supports in the relaxed position.

It is also contemplated that, in place of separate spaced resilient support blocks, a resilent support pad can be mounted on the base beneath the foot supports and, as a unitary member, over substantially the entire area therebetween. This is possible for both of the discussed embodiments 20 and 20*a*, and in the case of exerciser 20*a*, the electrical elements can be housed and protected in the large resilient pad.

Figure 9:
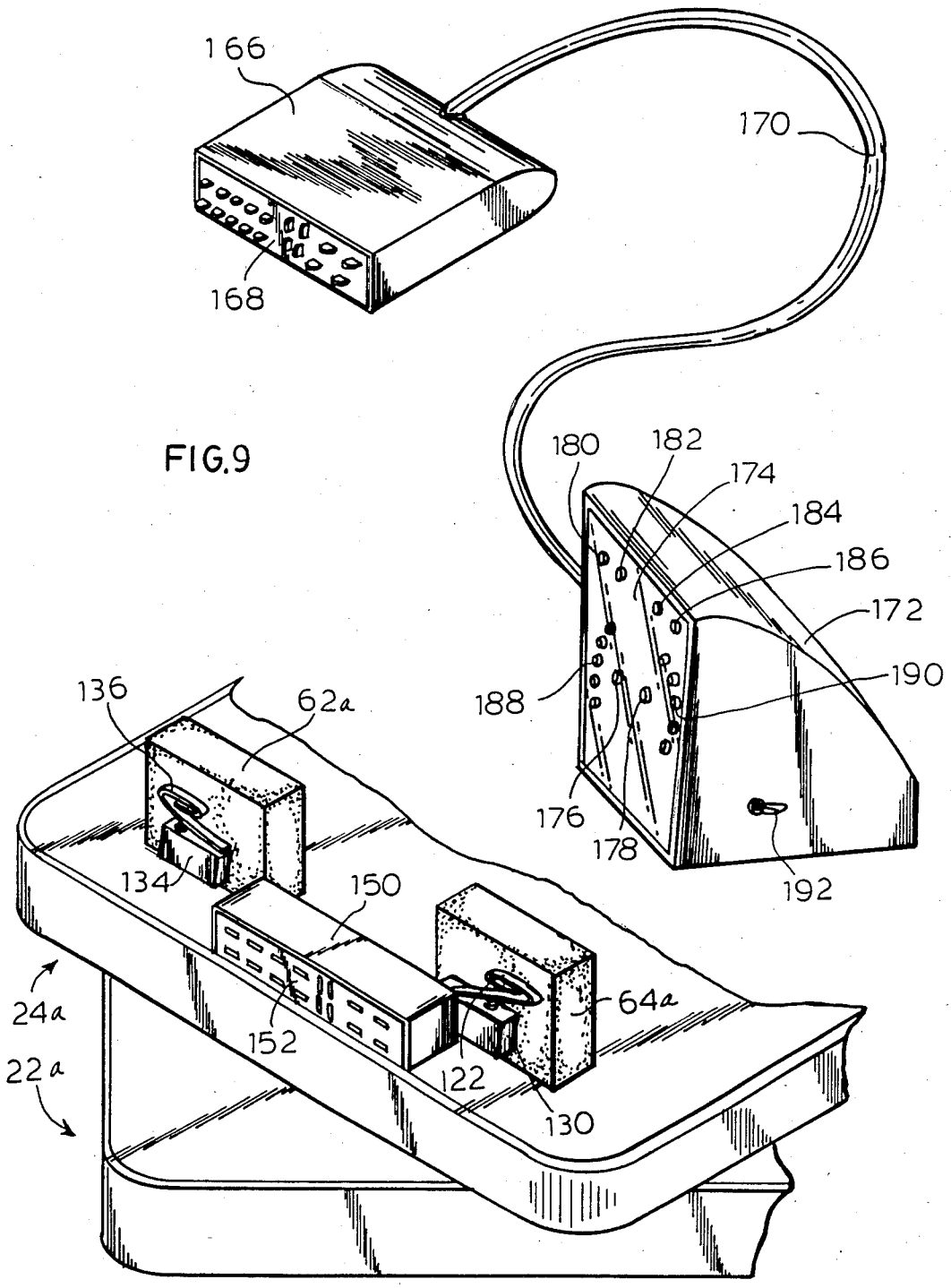
FIG. 9 is a fragmentary perspective view thereof and a perspective view of a display system adapted for use with the exerciser of the invention.
Figure 10:
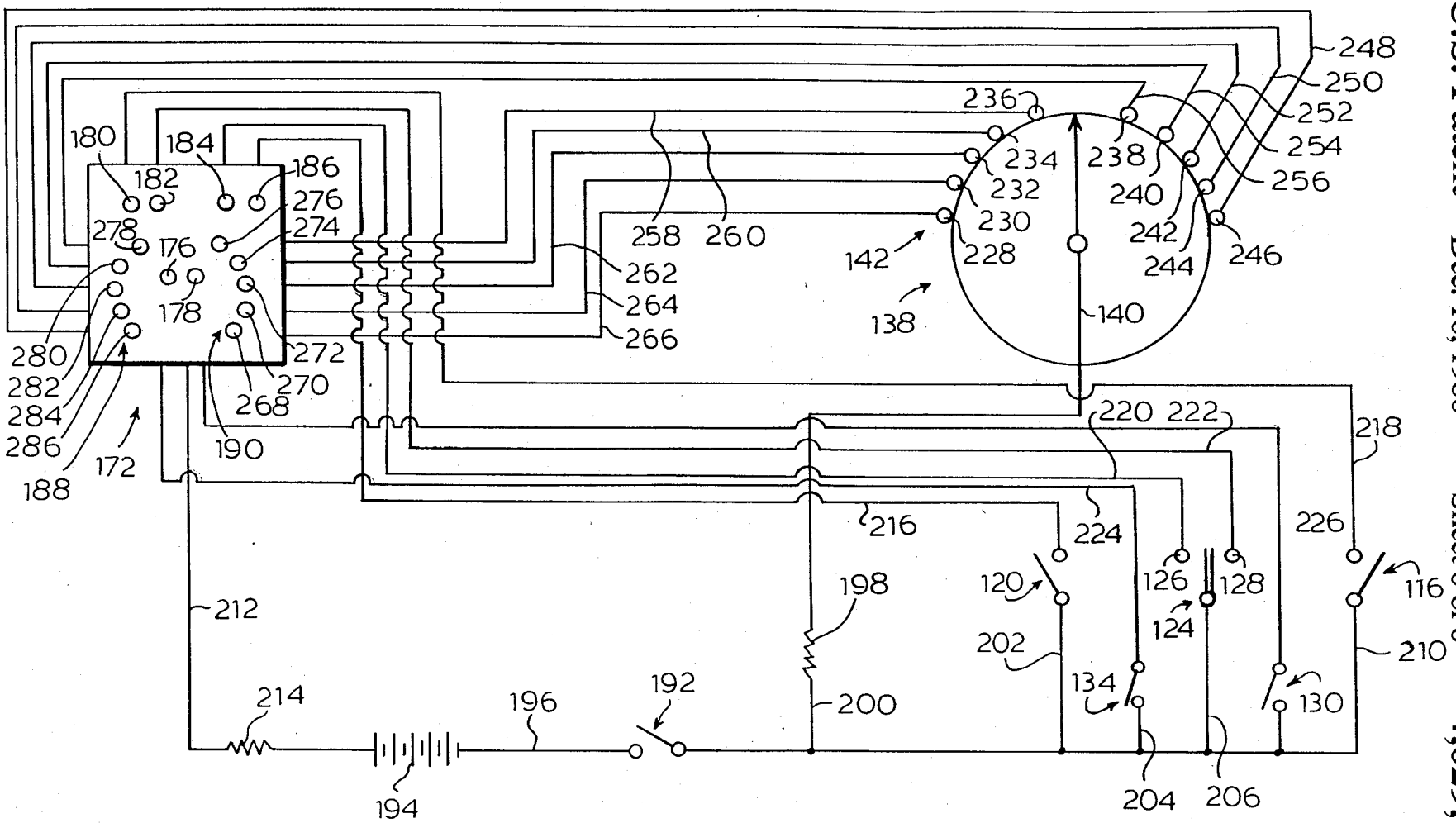
FIG. 10 is a schematic view of the circuitry employed in the alternative embodiment in combination with the display system.

FIG. 9 shows a type of display system that can be used to depict the results of the electrical sensing of movements of the foot supports as the exerciser 20*a* is used. A connector 166 with an arrangement of prongs 168 to fit the sockets 152 of terminal block 150 is connected by cable to a monitor 172. The display face 174 of monitor 172 has an arrangement of lights responsive to the respective sensor switches on exerciser 20*a*.

As shown, when connector 166 is interconnected with terminal block 150 and the operator engages the foot supports and proceeds with one or more of the four types of movement to simulate skiing or to merely go through an exercising procedure, the light arrangement on display face 174 will indicate the types of movement at any given point in time. For example, the two central lights 176 and 178 indicate activation of switches 130 and 134 respectively and show a pivoting action based on a change in weight distribution and the angular inclination of each of the two foot supports 26*a* and 28*a* independently. Lights 180 and 182 are actuated when switches 120 and 124 are activated to show a respective left and right cant of foot support 26*a*. Similarly, lights 184 and 186 are responsive to switches 118 and 124 respectively to indicate a left or right cant to foot support 28*a*.

The arcuate arrangement of lights 188 are responsive to engagement with the arcuate sequence of contacts 142 by sensor 140 of switch 138 to show the degree and amount of rotation to the left. The arcuate array of lights 190 show engagement of a similar array of contacts 142 by sensor 140 of sensor switch 138 as the operator rotates to the right to indicate the amount and degree of rotation. The monitor 172 is provided with a suitable off-on switch 192 to make its use with the exerciser 20*a* optional.

All of the switches in the system are coventional commercially available pressure sensitive transducers, for example of the type which obtains a piezoelectric effect. For instance, the pressure transducer piezoelectric switches manufactured by National Semi-Conductor would be satisfactory.

Also, a common light board with a pattern of incandescent lights is depicted in FIG. 9. As one alternative, light emitting diodes forming a vacuum fluorescent display can be used such as a V. U. meter in commercial stereo equipment manufactured by Hewlett Packard.

The circuitry of operation as described above is shown in FIG. 10 and can be described as follows.

Off-on swtich 192 is interconnected with power source 194 by a suitable electrical wire or connector 196. The power source can be in the form of a battery or conventional line voltage from an electrical socket. Through connector 196 the power is then supplied to the various switches on the exerciser with a suitable resistor 198 in the electrical path. Electrical connector 200 extends from electrical connector 196 to the rotary motion switch assembly 138. Similarly, connector 202 extends from connector 196 to switch 120, connector 204 from connector 196 to switch 134, connector 206 from connector 196 to switch 124, connector 208 from connector 196 to switch 130, and connector 210 from connector 196 to switch 116.

In this manner, power is supplied from the power source 194 to each of the switches on the exerciser.

The power source is also connected by line 212 to monitor 172 with a suitable resistor 214 positioned in the connecting line. The various switches on the exerciser are also directly interconnected with the monitor. Switch 120 is connected to light 186 through electrical line 216 and switch 116 is connected to light 180 through conduit 218. The dual switch 124 has one of the switches 126 connected to light 184 through conduit 220 and the other switch 128 connected through conduit 222 to light 182. Switch 134 is connected to light 176 through conduit 224 and switch 130 is connected to light 178 through electrical conduit 226.

The rotary sensor switch 138 has each of its arcuate array of contacts 142 individually connected to a display light on the two arcuate display arrays 188 and 190 of monitor 172.

Accordingly, sensor contact 228 is connected through line 266 to light 268. Sensor contact 230 is connected through electrical conduit 264 to light 272, contact 232 is connected through electrical conduit 262 to light 272, contact 234 is connected through conduit 260 to light 274, and contact 236 is connected through electrical conduit 258 to light 276. For rotation in the opposite direction, contact 246 is connected by conduit 248 to light 286, contact 244 is connected through conduit 250 to light 284, contact 242 is connected through conduit 252 to light 282, contact 240 is connected through conduit 254 to light 280, and contact 238 is connected through conduit to light 278.

Thus, each of the switches is directly connected to a display light so that movement on the exerciser can be accurately monitored.

It is also contemplated that, as an option, hand held switches and displays can be conventionally plugged into the displayed circuitry to provide the operator with direct controls as he uses the exerciser.

Accordingly, there are two types of embodiments of the present invention depicted in the drawings, one is mechanical and the other is electro-mechanical.

Exerciser 20*a*, having the electrical capabilities, is activated by transmitting body motions primarily through either, or both legs. It can be coupled to additional motion and/or position sensing devices, hand or otherwise activated trigger device. When used in conjunction with a computer device, the exerciser allows a wide range of leg, body, and hand movements to immediately interact with a game plan. This permits dimensional maneuvering by transmitting decisions through body movement to a display. Body english, in a horizontal rotary plane and/or vertical weighting-unweighting and/or an angulation of each or both legs are possible, but not all inclusive responses available to a user.

In addition to the skiing and general exercise and uses for the exerciser as described above, it is readily adaptable for use in other areas. For example in the medical environment, the exerciser is adaptable for use in post operative or recuperative therapy to help the patient regain the range of motion, particularly in the hip, knee, and ankle areas Muscle use can also be monitored by attaching sensors to the users body and using galvanometer readings to indicate precise interplay and extent of muscle involvement when the users legs are simulating physical activities. This would include both docile movement and vigorous movement such as encountered in skiing and horseback riding for example.

Another adaptation of the exerciser is in use as a foot wear fitting device. There are many types of special use foot wear which require accurate fitting, for example ski boots and mountain climbing boots. The boots can be tried on, and the user can gauge the fit while simulating actual environmental use activities.

Thus, the several afforenoted objects and advantages are most effectively attained. Although several somewhat preferred embodiments have been disclosed and described in detail herein, it should be understood that this invention is in no sense limited thereby and its scope is to be determined by that of the appended claims.

I claim:

1. An exerciser comprising: a base, a turntable rotatably mounted on the base, foot support means on the turntable so as to be rotatable therewith, the foot support means being moveable with respect to the turntable upon application of a predetermined amount of foot pressure so as to permit canting thereof in two opposing directions and pivoting in a third direction thereby permitting the user to selectively move his feet when engaged with the foot support means in any one or in a combination of four directions of movement depending on the application of leg and foot pressure thereto and accordingly allowing the user to exercise in a desired manner, the foot support means including a pair of spaced foot supports to selectively support the feet of a user, the surface of each foot support adapted to be engaged by the user including a frictional surface to deter relative movement therebetween, a side wall portion and a to wall portion extending upward from the foot engagement surface to facilitate retention of foot position relative to the foot support as the user moves his foot and the foot suport relative to the turntable and the base in selected directions, means is provided for facilitating canting of each foot support in two opposing directions and includes a cylindrical member mounted in fixed position on the surface of the turntable and being seated in a receiving recess in the under surface of the toe portion of the foot support so that the foot support can rotate about the cylindrical member in two opposing directions, a resilient heel support extending upward from the turntable into engagement with the underside of the heel portion of the foot support, a pair of spaced aligned resilient toe supports extending upward a lesser distance than the heel support so that the heel portion of the foot support is supported at a higher position than the toe portion thereby maintaining the foot support in an inclined position and the resilient supports permitting a predetermined degree of canting of each foot support in opposite directions about the cylindrical member and pivoting of the foot support to change the relative elevation of the toe and heel portions and degree of incline during use.

2. The invention in accordance with claim 1 wherein there is a separate cylindrical member, a separate heel support, and a separate pair of toe supports for each foot support.

3. The invention in accordance with claim 1 wherein the heel and tow supports are formed of rubber material adhesively bonded to the turntable.

4. An exerciser comprising: a base, a turntable rotatably mounted on the base, foot support means on the turntable so as to be rotatable therewith, the foot support means being moveable with respect to the turntable upon application of a predetermined amount of foot pressure so as to permit canting thereof in two opposing directions and pivoting in a third direction thereby permitting the user to selectively move his feet when engaged with the foot support means in any one or in a combination of four directions of movement depending on the application of leg and foot pressure thereto and accordingly allowing the user to exercise in a desired manner, the canting movement being about a longitudinal axis of the foot support means corresponding to a longitudinal axis of a user's foot positioned on the foot support means so as to permit shifting of the relative elevation of the inside and outside edges of the foot and the pivoting movement being about a transverse axis of the foot support means corresponding to a transverse axis of a user's foot positioned on the foot support means so as to permit shifting of the relative elevation of the heel portion and toe portion of the user, the foot support means includes a pair of spaced foot supports to selectively support the feet of a user, each foot support adapted to be independently canted and pivoted with respect to the other foot support and the turntable, the foot support means is provided for facilitating canting of each support and includes a fulcrum member mounted on the turntable and engaging a receiving surface on the under surface of the foot support adjacent the portion of the foot support where the toe and ball portions of the foot of the user engages the foot support.

5. The invention in accordance in claim 4 wherein a bearing assembly is mounted between the base and the turntable to permit 360° relative rotation therebetween.

6. The invention in accordance with claim 5 wherein the bearing assembly includes a first plate affixed to the base, a second plate affixed to the turntable in position to mate with the first plate, a race formed by surfaces on the mating plates, a plurality of ball bearings captured in the race and forming the engaging surface upon which the turntable can rotate with respect to the base.

7. The invention in accordance with claim 4 wherein the surface of each foot support adapted to be engaged by the user includes a frictional surface to deter relative movement therebetween, a side wall portion and toe wall portion extending toward from the foot engagment surface to facilitate retention of foot position relative to the foot support as the user moves his foot and the foot support relative to the turntable and the base in selected directions.

8. The invention in accordance with claim 7 wherein each side wall portion is an L-bracket with one leg fastened to the upper surface of a foot support and the other leg substantially aligned with at least a portion of the edge of the foot support distal from the other foot support and extending upwardly from the upper surface of the foot support.

9. The invention in accordance with claim 7 wherein each toe wall portion includes an L-bracket formed of three segments in the form of a shorter central segment and two longer end segments extending angularly from the ends of the central segments so that the toe wall portion generally conforms to the shape of the toe portion of the user's shoe, one leg of each toe wall portion L-bracket fastened to the upper surface of a foot support and the other leg being substantially aligned with the adjacent edge of the foot support and extending upwardly therefrom.

10. The invention in accordance with claim 7 wherein the friction surface includes a ribbed pad affixed to a substantial portion of the upper surface of each foot support.

11. The invention in accordance with claim 4 wherein sensing means is positioned so as to monitor the degree of movement of the foot support means as the user moves the foot support means relative to the base.

12. The invention in accordance with claim 11 wherein display means in responsive to the sensing means to indicate the type and degree of sensed movement of the foot support means as the user operates the exerciser.

13. The invention in accordance with claim 12 wherein the sensing means includes at least one electrical sensor switch and the display means includes an electrical display board, and the switches and display board interconnected at a releasable electrical interface.

14. The invention in accordance with claim 13 wherein the foot support means includes a pair of spaced foot supports to respectively support the feet of a user, there is a first sensor switch located adjacent the heel portion of each foot support, a second sensor switch adjacent one side edge of each foot support, and a third sensor switch adjacent the other side edge of each foot support so as to be engaged and activated as each foot support is pivoted and canted from one side to the other respectively, and a rotation sensor switch positioned to sense the degree of rotation of the turntable and accordingly the foot supports rotating therewith as the user operates the exerciser.

15. The invention in accordance with claim 4 wherein the fulcrum member is cylindrical in configration and the heel portion of each foot support is at a higher elevation than the toe portion of each foot support in the relaxed condition, and a toe wall portion extending up from each foot support in position to be engaged by the toe portion of the foot of the user to facilitate retention of foot position relative to the foot support during use of the exerciser.

16. An Exerciser comprising; a base, a turntable rotatably mounted on the base, foot support means on the turntable so as to be rotatable therewith, the foot support means being movable with respect to the turntable upon application of a predetermined amount of foot pressure so as to permit canting thereof in two opposing directions and pivoting in a third direction thereby permitting the user to selectively move his feet when engaged with the foot support means in any one or in a combination of four directions of movement depending on the application of leg and foot pressure thereto and accordingly allowing the user to exercise in a desired manner, the canting movement being about a longitudinal axis of a user's foot positioned on the foot support means so as to permit shifting the relative elevation of the inside and outside edges of the foot and the pivoting movement being about a transverse axis of the foot support means corresponding to a transverse axis of a user's foot positioned on the foot support means so as to permit shifting of the relative elevation of the heel portion and toe portion of the user, the foot support means includes a pair of spaced foot supports to selectively support the feet of a user, each foot support adapted to be independently canted and pivoted with respect to the other foot support and the turntable, a resilient heel extends upward from the turntable into engagment with the underside of the foot support at the location where the heel of the user engages the foot support and at least one resilient toe support extending up from the turntable into engagement with the portion of the foot support engaged by the toes of the foot of a user, and the foot support being mounted with the heel and toe portions thereof at different elevations whereby pivoting about a transverse axis will permit shifting of the relative elevations of the heel and toe portion of the foot support and this movement being accommodated by the resilient supports.

* * * * *

UNITED STATES PATENT AND TRADEMARK OFFICE

CERTIFICATE OF CORRECTION

PATENT NO. : 4,629,181

DATED : December 16, 1986

INVENTOR(S) : Irwin M. Krive

It is certified that error appears in the above-identified patent and that said Letters Patent is hereby corrected as shown below:

| | |
|---|---|
| Column 12, Line 13, | "a to wall portion" should read --a toe wall portion--; |
| Claim 7, Line 5, | the word "toward" should be --upward--; |
| Claim 15, Line 2, | the word "configration" should be --configuration--; |
| Claim 16, Line 39, | "shifting the" should read --shifting of the--; |
| Claim 16, Lines 49 and 50, | "resilient heel extends" should read --resilient heel support extends--. |

Signed and Sealed this

Thirty-first Day of March, 1987

*Attest:*

*Attesting Officer*

DONALD J. QUIGG

*Commissioner of Patents and Trademarks*